US011897669B2

(12) United States Patent
Tanaka et al.

(10) Patent No.: US 11,897,669 B2
(45) Date of Patent: Feb. 13, 2024

(54) SPOUT CAP, SPOUT, AND CONTAINER WITH SPOUT

(71) Applicant: HOSOKAWA YOKO CO., LTD., Tokyo (JP)

(72) Inventors: Hideki Tanaka, Toyama (JP); Ryosuke Miyawaki, Tokyo (JP)

(73) Assignee: HOSOKAWA YOKO CO., LTD., Tokyo (JP)

( * ) Notice: Subject to any disclaimer, the term of this patent is extended or adjusted under 35 U.S.C. 154(b) by 220 days.

(21) Appl. No.: 17/290,604

(22) PCT Filed: Jan. 27, 2020

(86) PCT No.: PCT/JP2020/002672
§ 371 (c)(1),
(2) Date: Apr. 30, 2021

(87) PCT Pub. No.: WO2020/158637
PCT Pub. Date: Aug. 6, 2020

(65) Prior Publication Data

US 2021/0394977 A1 Dec. 23, 2021

(30) Foreign Application Priority Data

Jan. 31, 2019 (JP) ..... 2019-015304

(51) Int. Cl.
*B65D 47/36* (2006.01)
*B65D 75/58* (2006.01)

(52) U.S. Cl.
CPC ..... *B65D 47/36* (2013.01); *B65D 75/5861* (2013.01); *B65D 2547/063* (2013.01)

(58) Field of Classification Search
CPC ..... B65D 75/70; B65D 75/5883; B65D 75/5861; B65D 55/024; B65D 53/02;
(Continued)

(56) References Cited

U.S. PATENT DOCUMENTS 5,592,046 A 1/1997 Kim
6,283,318 B1 9/2001 Lee
(Continued)

FOREIGN PATENT DOCUMENTS

CN 102307787 A 1/2012
CN 102458341 A 5/2012
(Continued)

OTHER PUBLICATIONS

Chinese Office Action (CNOA) dated Dec. 21, 2022 for Chinese Patent Application No. 202080006121.0; Partial English translation.

(Continued)

*Primary Examiner* — James N Smalley
*Assistant Examiner* — Madison L Poos
(74) *Attorney, Agent, or Firm* — RANKIN, HILL & CLARK LLP

(57) ABSTRACT

The spout cap of the present invention includes: a cap body that tubularly surrounds a mouth portion of a spout body, and is an injection molded article made of resin; and a sealing film that is bonded to one side in a penetration direction of the cap body and can be thermally bonded to a tip surface of the mouth portion. The cap body includes a tubular body portion, and a tab portion disposed outside in a caliber direction with respect to the body portion. The tab portion includes a tab base portion that projects outward in the caliber direction from the other side in the penetration direction of the body portion, and a tab body portion that extends from the tab base portion toward the one side in the penetration direction and faces the body portion on an outside in the caliber direction.

7 Claims, 9 Drawing Sheets

(58) Field of Classification Search
CPC ..... B65D 47/38; B65D 47/36; B65D 47/127; B65D 41/50; B65D 41/485; B65D 41/18; B65D 2547/063; B65D 2401/20
USPC ..... 220/258.2
See application file for complete search history.

(56) References Cited

U.S. PATENT DOCUMENTS

| | | | |
|---|---|---|---|
| 9,493,284 | B2 | 11/2016 | Tsuruta et al. |
| 10,279,967 | B2 | 5/2019 | Wei |
| 10,945,508 | B2 | 3/2021 | Wei |
| 2011/0253713 | A1 | 10/2011 | Ichikawa et al. |
| 2012/0067459 | A1 | 3/2012 | Kunishige et al. |
| 2015/0166234 | A1 | 6/2015 | Wei |
| 2015/0274391 | A1 | 10/2015 | Tsuruta et al. |
| 2020/0375339 | A1 | 12/2020 | Wei |

FOREIGN PATENT DOCUMENTS

| | | | | |
|---|---|---|---|---|
| CN | 104379022 | A | 2/2015 | |
| CN | 104709594 | A | 6/2015 | |
| CN | 104755380 | A | 7/2015 | |
| DE | 102007030156 | | 1/2009 | |
| JP | 56-166279 | U | 12/1981 | |
| JP | 7-69358 | A | 3/1995 | |
| JP | 9-77101 | A | 3/1997 | |
| JP | 10-264950 | A | 10/1998 | |
| JP | 2000-506474 | A | 5/2000 | |
| JP | 2001-97437 | A | 4/2001 | |
| JP | 2001-130609 | A | 5/2001 | |
| KR | 200196301 | | 9/2000 | |
| KR | 20040053085 | | 6/2004 | |
| TW | 201838887 | A | 11/2018 | |
| WO | 97/33802 | A1 | 9/1997 | |
| WO | WO-2009000343 | A1 * | 12/2008 | ..... B65D 55/16 |
| WO | WO-2017126555 | A1 * | 7/2017 | ..... B65D 41/185 |

OTHER PUBLICATIONS

International Search Report (ISR) dated Mar. 31, 2020 filed in PCT/JP2020/002672.
Extended European Search Report (EESR) dated Oct. 31, 2022 for the corresponding European Patent Application No. 20748911.3.
Chinese Office Action (CNOA) dated Jul. 5, 2022 for Chinese Patent Application No. 202080006121.0; Partial English translation.

* cited by examiner (A)

(B)

(C)

SPOUT CAP, SPOUT, AND CONTAINER WITH SPOUT

TECHNICAL FIELD

A container with a spout includes a container body and a spout. Further, the spout includes a spout body and a spout cap. The present invention relates to the spout cap, the spout, and the container with the spout.

BACKGROUND ART

Conventionally, the container with the spout is known as a container for storing foodstuffs such as liquid beverages, fluid foods and seasonings, and daily necessities such as liquid detergents and liquid cleaning agents. Generally, the container with the spout includes the container body for storing contents and the spout fixed to the container body. Note that the spout includes the spout body and the spout cap as described above. Then, the spout body allows the contents to pass through its mouth portion, and the spout cap closes the mouth portion of the spout body. A sealing film may be provided on a tip surface of the mouth portion of the spout body, and the sealing film prevents the contents from leaking to an outside.

Patent Literature 1 describes a pouch container with a spout in which the mouth portion of the spout body is closed with an inner seal as the sealing film and a screw cap is fitted to the mouth portion. Since the inner seal is provided with, as a tab portion, an overhanging portion that overhangs outward in a caliber direction with respect to the mouth portion, it is configured to be easier to be peeled off than a seal without the overhanging portion.

Further, Patent Literature 2 describes a seal structure of a spout for a pouch in which the mouth portion of the spout body is closed with a sealing portion as a sealing film and a cover plate is provided on the sealing portion. The sealing portion is sufficiently larger than an outer periphery of the spout body and is easy to be pinched, and the mouth portion of the spout body can be opened by a single operation of peeling off the sealing portion.

CITATION LIST

Patent Literature

Patent Literature 1: JP-A-2001-097437
Patent Literature 2. JP-A-2001-130609

SUMMARY OF THE INVENTION

Problems to be Solved by the Invention

However, in a structure described in Patent Literature 1, although the inner seal is provided with the overhanging portion as the tab portion, the overhanging portion is not so large, so that it is difficult to be pinched. Therefore, it is difficult to open the mouth portion of the spout body. Incidentally, the inner seal is film-like and is very thin. Therefore, the inner seal is difficult to be pinched by a human hand and is difficult to be peeled off.

Further, in order to open the mouth portion of the spout body, it is necessary to perform two operations of removing the screwcap and peeling off the inner seal.

Furthermore, to remove the screw cap, while holding a container-side portion with respect to the screw cap with one hand, the screw cap is pinched with fingers of the other hand and rotated. A rotation operation of the screw cap is generally not an easy operation for children and the elderly, and improvement is required.

Further, in the structure described in Patent Literature 2, the mouth portion of the spout body can be opened by a single operation as described above, but the sealing portion is thin and has low rigidity, so that it is difficult to pinch the sealing portion with the fingers. Therefore, it is difficult to open the mouth portion of the spout body.

Moreover, the mouth portion of the spout body is a portion that a user holds in his/her mouth, and since a periphery of the mouth portion is not surrounded, it is not sanitary.

The present invention has been created in consideration of the above circumstances, and is premised on providing a spout cap that achieves secure closing, easiness of an opening operation, and sanitization of the mouth portion of the spout body. In addition, an object of the present invention is to provide a spout cap having a structure suitable for mass production. Furthermore, another object of the present invention is to provide a spout using the spout cap that achieves such an object, and a container with a spout.

Solution to the Problems

A spout cap of the present invention includes: a cap body that is an injection molded article made of resin, and tubular surrounds a mouth portion of a spout body; and a sealing film that is bonded to one side in a tubular penetration direction of the cap body and can be thermally bonded to a tip surface of the mouth portion to seal the mouth portion of the spout body. Then, the cap body includes a tubular body portion, and a tab portion disposed outside in a caliber direction of the body portion. Further, the tab portion includes a tab base portion that projects outward in the caliber direction from the other side in the penetration direction of the body portion, and a tab body portion that extends from the tab base portion toward one side in the penetration direction and faces the body portion on an outside in the caliber direction. Then, the tab body portion is annular and can be deformed outward in the caliber direction of the body portion with respect to the tab base portion.

Further, since the tab body portion extends from the tab base portion toward the one side in the penetration direction and is annular, specifically, the tab body portion includes a bifurcated portion extending to the one side in the penetration direction while branching in a circumferential direction of the body portion from the tab base portion, and a finger hook portion that joins both end portions on the one side of the bifurcated portion and is hooked by a finger. Then, it does not matter whether the finger hook portion and the tab base portion overlap each other when viewed from the penetration direction of the body portion. However, when the finger hook portion and the tab base portion overlap each other when viewed from the penetration direction of the body portion, the finger hook portion is a so-called undercut if a mold opening direction of a mold is aligned with the penetration direction of the body portion. Then, the spout cap having a structure that is less likely to be undercut is more suitable for mass production by injection molding than the spout cap having a structure that has an undercut. Therefore, in order to make the spout cap a structure more suitable for mass production, it is desirable to do the following.

That is, the finger hook portion is disposed outside in the caliber direction of the body portion with respect to the tab base portion.

Further, it does not matter whether the finger hook portion is adjacent to or away from the tab base portion on an outside in the caliber direction of the body portion when viewed from the penetration direction of the body portion, but to make it easy to pass the finger through the tab body portion, it is desirable to do the following.

That is, the finger hook portion is disposed apart outs outward in the caliber direction of the body portion from the tab base portion.

Further, when a plurality of spout caps is put into, for example, a parts feeder or a container, the spout caps may be entangled with each other. Incidentally, an example of the spout cap having a structure that is easily entangled includes a spout cap having a structure in which the body portion includes an arcuate arc portion that bulges outward in the caliber direction when viewed from the penetration direction, and the finger hook portion is disposed apart outward in the caliber direction from the arc portion when viewed from the penetration direction of the body portion, and has a linear shape extending parallel to a tangential direction of the arc portion. Then, in order to prevent the spout caps from being entangled with each other as much as possible, it is desirable to do the following.

That is, the body portion has an arcuate arc portion that bulges outward in the caliber direction when viewed from the penetration direction, and the finger hook portion also has an arcuate shape that bulges outward in the caliber direction when viewed from the penetration direction of the body portion, and is disposed apart outward in the caliber direction from the arc portion.

Further, the body portion may be any one that tubularly surrounds the mouth portion of the spout body, and it does not matter whether the body portion is a complete tube that is continuous over a total length in the penetration direction and a total length in the circumferential direction. Note that to perform the opening operation of removing the spout cap from the spout body, the finger may be passed through the tab body portion, or the finger hook portion may be held, a side opposite to the mouth portion of the spout body may be pinched, and the tab portion may be pulled so as to be separated from the spout body. Then, in order to facilitate the opening operation, it is desirable to do the following.

That is, the body portion includes a pair of breaking portions that breakably joins both sides in a circumferential direction with respect to the tab base portion and extends toward one side from the other side end in the penetration direction of the body portion, a pair of first slit portions extending in the circumferential direction from the one side end of the pair of breaking portions, and a pair of intermediate joint portions that joins a portion on the one side and a portion on the other side in the penetration direction with the pair of first slit portions as boundaries, between the pair of first slit portions. Then, the intermediate joint portion on an opposite side of the tab portion out of the pair of intermediate joint portions is a hinge portion.

Further, the spout of the present invention includes the above-mentioned spout cap and the spout body attached to the mouth portion of the container body.

Further, the container with the spout of the present invention includes the above-mentioned spout and the container body.

Effects of the Invention

Since the spout cap of the present invention is formed so that the tab body portion faces the body portion on the outside in the caliber direction, a recess corresponding to a cavity (space portion) can be formed only in a female mold of the mold for manufacturing the cap body, and it can be said that the structure is suitable for mass production in injection molding.

Moreover, in the spout cap of the present invention, since the cap body tubularly surrounds the mouth portion of the spout body, the mouth portion can be sanitary, the sealing film can be thermally bonded to the tip surface of the mouth portion of the spout body so that the mouth portion can be securely closed, and the tab body portion that extends in the penetration direction of the body portion can be deformed outward in the caliber direction, and thus by deforming the tab body portion, it is easy to pass the finger through the tab body portion, which facilitates the opening operation of removing the cap body from the mouth portion of the spout body.

Further, in the spout cap of the present invention, if the tab body portion includes the bifurcated portion and the finger hook portion, and the finger hook portion is disposed outside in the caliber direction of the body portion with respect to the tab base portion when viewed from the penetration direction of the body portion, the finger hook portion is less likely to be undercut as compared to, for example, the spout cap in which the finger hook portion is overlapped with the tab base portion when viewed from the penetration direction of the body portion, and the spout cap is more suitable for mass production by injection molding.

Further, in the spout cap of the present invention, if the finger hook portion is apart outward in the caliber direction of the body portion from the tab base portion when viewed from the penetration direction of the body portion, it is easier to pass the finger through the tab body portion as compared to, for example, the spout cap in which the tab body portion is adjacent to the tab base portion in the caliber direction of the body portion when viewed from the penetration direction of the body portion, which facilitates the opening operation of removing the spout cap from the mouth portion of the spout body.

Further, in the spout cap of the present invention, if the body portion includes the arc portion and the finger hook portion is also arcuate, for example, when the plurality of spout caps is put into the parts feeder in order to attach the spout cap to the spout body, the spout caps are less likely to be entangled with each other, and productivity is improved.

Further, in the spout cap of the present invention, if the body portion includes the pair of breaking portions, the pair of slit portions and the pair of intermediate joint portions, and the intermediate joint portion on the opposite side of the tab portion out of the pair of intermediate joint portions is the hinge portion, the opening operation of removing the spout cap from the mouth portion of the spout body is easy. More specifically, in such a spout cap, in the opening operation of removing the spout cap from the mouth portion of the spout body, the other side portion of the body portion with respect to the pair of slit portions is divided into two parts, a side opposite to the tab portion and the tab portion side, by the pair of breaking portions, and at the time of that division, the side opposite to the tab portion is displaced to open relatively to the tab portion side with the hinge portion as a fulcrum, and the opening operation is easier than that of, for example, the spout cap without the breaking portion, the pair of slit portions, or the hinge portion.

Further, since the spout and the container with the spout of the present invention include the spout cap described above, they have effects of the spout cap described above.

DESCRIPTION OF THE EMBODIMENTS

A container with a spout of the present invention includes a container body for storing contents and a spout fixed to a mouth portion of the container body and through which the contents pass. Incidentally, the container body is bag-shaped as an example.

Figure 1:
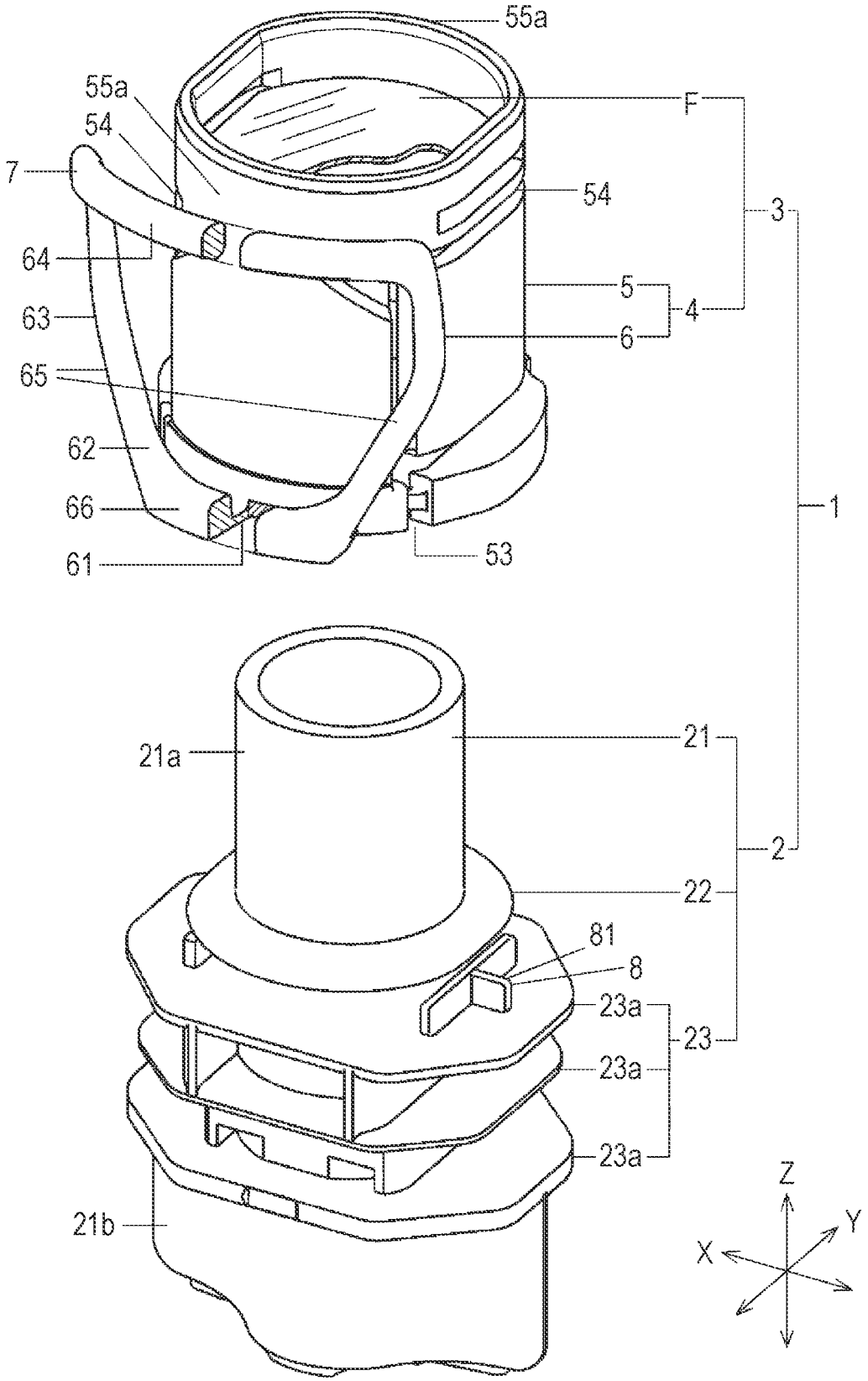
FIG. 1 is an exploded perspective view illustrating a spout according to a first embodiment of the present invention.
Figure 2:
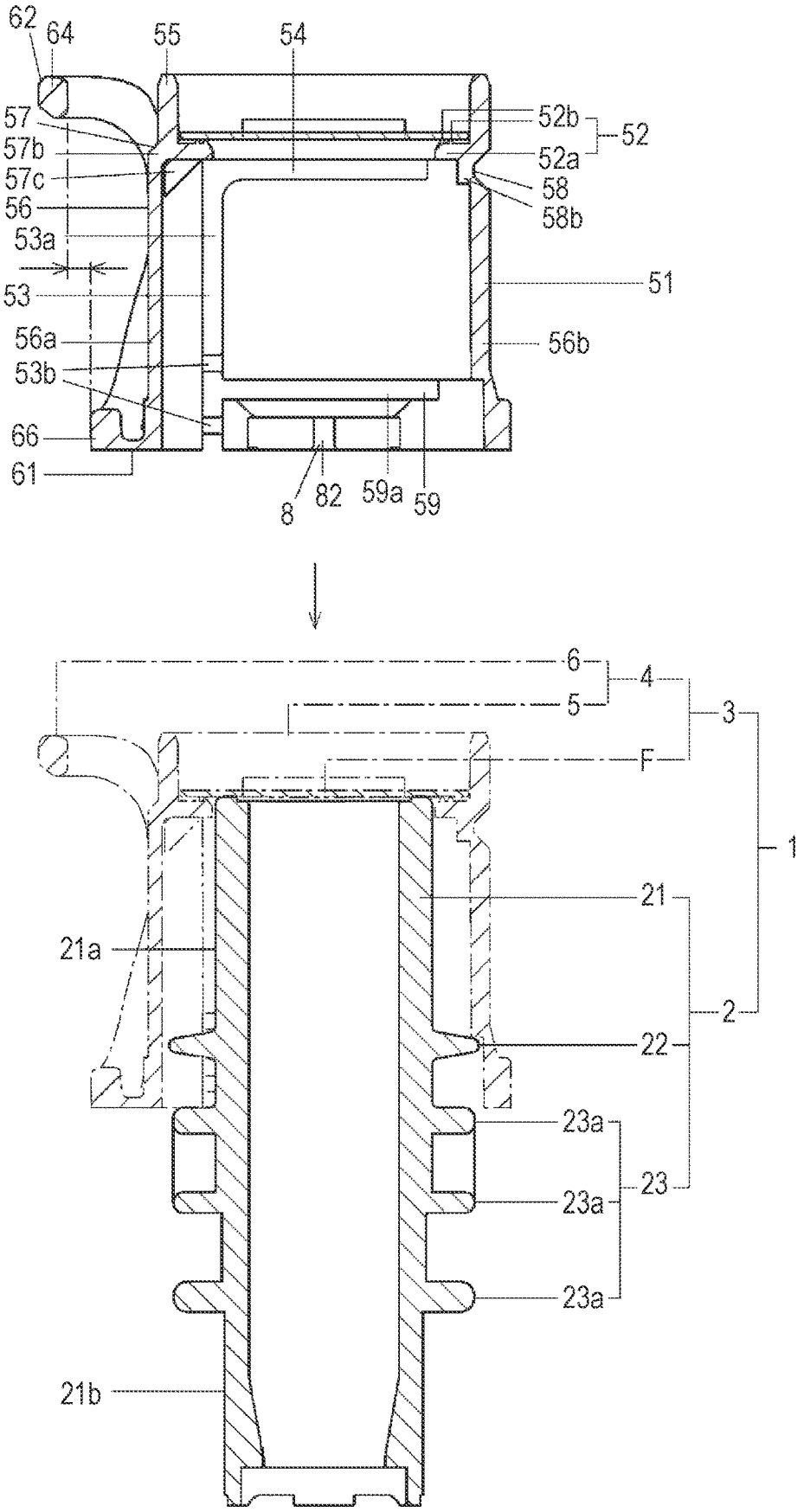
FIG. 2 is a cross-sectional view illustrating the spout of the first embodiment.
Figure 3:
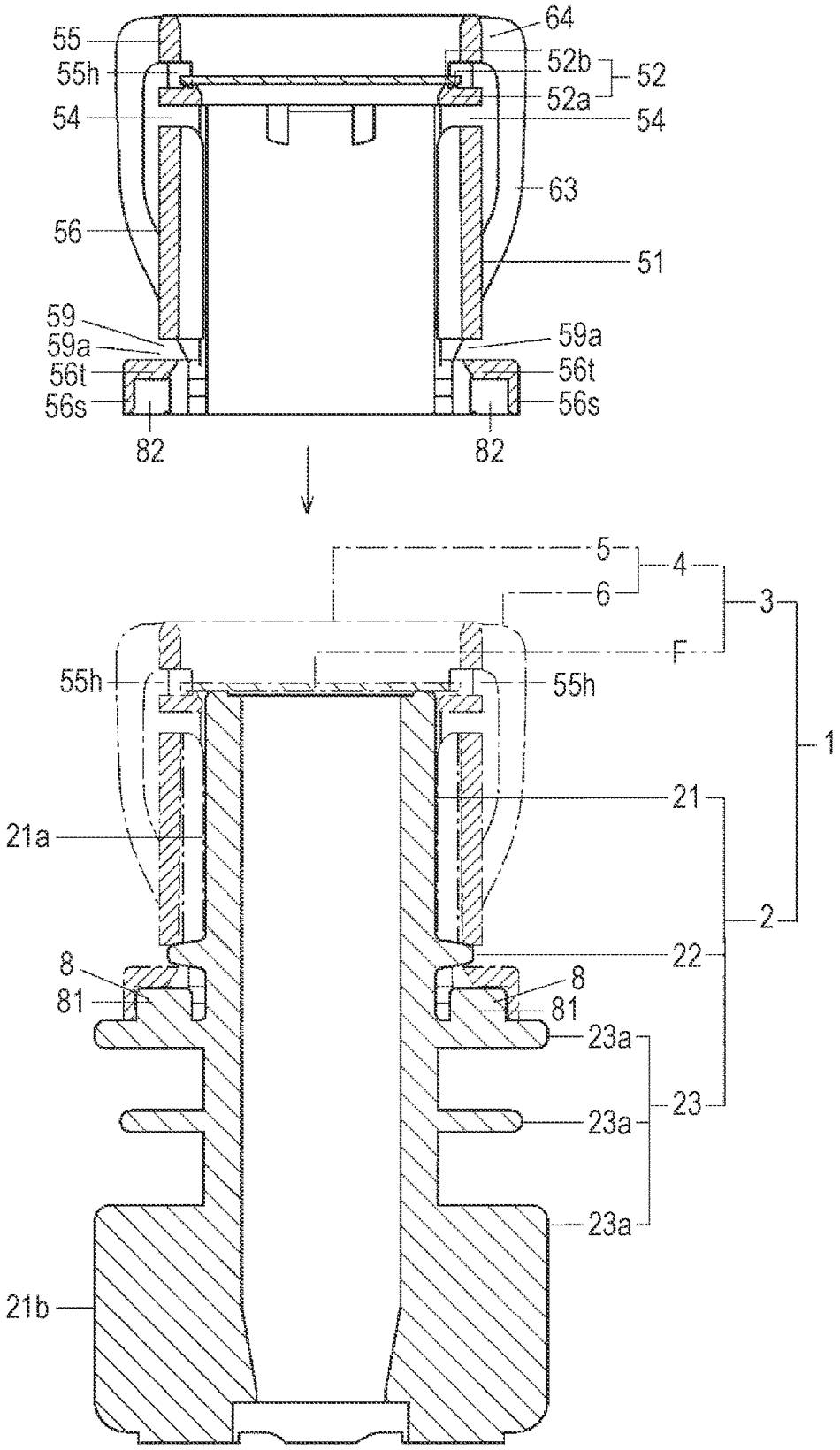
FIG. 3 is a cross-sectional view illustrating the spout of the first embodiment.

As illustrated in FIGS. 1 to 3, a spout 1 of a first embodiment of the present invention includes a spout body 2 that is attached to the mouth portion of the container body (not shown) and passes the contents to an outside therethrough, and a spout cap 3 (hereinafter, referred to as the spout cap 3 of the first embodiment) that closes a mouth portion 21*a* of the spout body 2.

Since the spout body 2 has a hole penetrating therethrough, the contents pass therethrough. Therefore, the spout body 2 has a penetration direction. Incidentally, penetration directions correspond to vertical directions in FIGS. 1 to 3. Further, in FIG. 1, the penetration direction is indicated by a straight line with a reference numeral Z. Further, one side in the penetration direction is a side opposite to the container body, that is, a counter-container body side, and is an upper side in FIGS. 1 to 3. Furthermore, the other side in the penetration direction is a container body side, and is a lower side in FIGS. 1 to 3.

Further, the spout body 2 is an injection-molded article made of resin, and any of resins exemplified is used for a cap body 4 described below. Then, the spout body 2 includes a straw 21 that serves as a passage for the contents. The straw 21 is tubular, and is cylindrical in an illustrated example. Further, since the straw 21 is tubular, there is a caliber direction. Then, the straw 21 has the mouth portion 21*a* on the counter-container body side with respect to an intermediate portion of a total length in the penetration direction, and a container attachment portion 21*b* on the container body side with respect to the intermediate portion. The mouth portion 21*a* of the straw 21 is also the mouth portion 21*a* of the spout body 2.

Hereinafter, terms of the penetration direction and the caliber direction will be used not only for the spout body 2 but also for the spout cap 3.

Further, in addition to the straw 21, the spout body 2 includes a straw-side fitting portion 22 formed on an outer peripheral surface of the mouth portion 21*a* of the straw 21 and fitted to the spout cap 3, and a grip portion 23 that projects outward in the caliber direction from the outer peripheral surface between the counter-container body side and the container body side (in the intermediate portion in the penetration direction) of the straw 21, can be gripped when the spout cap 3 is removed, and is also used to hold the container with the spout by a filling machine when the contents are filled. Details of the straw-side fitting portion 22 will be described together with details of the spout cap 3.

The grip portion 23 includes a plurality of flanges 23*a* arranged apart from each other in the penetration direction. Further, the flange 23*a* includes a portion that projects outward in the caliber direction from the straw-side fitting portion 22 when viewed from the penetration direction. Then, as illustrated in FIG. 1, the flan 23*a* is formed to be longer in the other direction X than in one direction Y of two directions X and Y perpendicular to each other in the caliber direction when viewed from the penetration direction Z. Further, portions extending in the two directions X and Y project outward in the caliber direction from the straw-side fitting portion 22.

As illustrated in FIGS. 1 to 3, the spout cap 3 includes the cap body 4 that tubularly surrounds the mouth portion 21*a* of the spout body 2, and a sealing film F that is joined to the counter-container body side in the penetration direction of the cap body 4.

The sealing film F is joined to the cap body 4. The sealing film F and the cap body 4 are joined by, for example, thermal joining (welding), preferably insert molding. More specifically, the cap body 4 is an injection-molded article made of resin, and the sealing film F and the cap body 4 are joined with each other by pouring the resin after placing the sealing film F as an insert product in a mold in advance at the time of injection molding.

Further, the sealing film F is a laminated film that can be thermally bonded to a tip surface (an upper end surface) of the mouth portion 21*a* in order to seal the mouth portion 21*a* of the spout body 2. The sealing film F includes a thermal bonding layer that can be thermally bonded to the cap body 4 and the spout body 2, and a base material layer that is made of a material different from the thermal bonding layer and is laminated and integrated with the thermal bonding layer.

The base material layer can be a film having piercing strength, tensile strength, impact resistance, and the like. Examples of the material of the base material include polyethylene terephthalate, polypropylene, polyamide, ethylene vinyl alcohol copolymer and the like, and these biaxially stretched films or uniaxially stretched films can be used. Further, in order to impart a barrier property to these films against oxygen, water vapor, and light rays such as ultraviolet rays, for example, a vapor-deposited film obtained by depositing a metal such as aluminum or magnesium or an oxide such as silicon oxide, and a coating film coated with a barrier coating agent such as polyvinylidene chloride may be used. The base material layer may be a single body or a laminated body of the above-mentioned film. Further, the base material layer may be a vapor-deposited layer in which the metal such as aluminum or magnesium or the oxide such as silicon oxide is directly vapor-deposited on the thermal bonding layer, or a coating layer coated with, for example, the barrier coating agent such as polyvinylidene chloride.

The thermal bonding layer is a resin film. The thermal bonding layer is a layer that can be thermally melted and thermally bonded within a temperature range in which a shape of the base material layer can be maintained. Examples of materials of the resin for the thermal bonding layer include polyethylene such as high-density polyethylene, low-density polyethylene, and linear low-density polyethylene, polypropylene, and the like, and the thermal bonding layer may be unstretched films of the above-mentioned resin or the above-mentioned resin extruded in layers. Of these resins, the same type of resin that can be thermally bonded to the cap body 4 is used. Further, when the spout cap is exposed to a retort treatment of high-temperature heat sterilization, polypropylene or high-density polyethylene having excellent heat resistance is preferably used.

The sealing film F may have an intermediate layer between the base material layer and the thermal bonding layer, if necessary. Examples of the intermediate layer include a film having functionality such as oxygen barrier property, water vapor barrier property, and tearing property. Specific examples of the intermediate layer include a metal layer such as aluminum, the above-mentioned vapor-deposited film, and a coated film.

The sealing film F including the base material layer, the thermal bonding layer, and the intermediate layer that is used as needed can be produced by a known method such as a dry lamination method using an adhesive or an extrusion lamination method using a thermosetting resin.

The cap body 4 is the injection molded article made of resin.

Examples of the resin used for the cap body 4 include polyolefin resin, polyamide resin, polyester resin, (meth) acrylic resin, vinyl chloride resin, vinylidene chloride resin, polyether sulfone, ethylene-vinyl alcohol copolymer and the like. Of these, the polyolefin resin is preferable because it is excellent in processability and low in cost. Examples of the polyolefin resin include polyethylene-based resins such as high-density polyethylene, medium-density polyethylene, high-pressure low-density polyethylene, linear low-density polyethylene, and ethylene-vinyl acetate copolymer, olefin-based elastomer such as ethylene-α-olefin copolymer, polypropylene-based resins such as polypropylene, ethylene-propylene random copolymer, and α-olefin-propylene random copolymers, and cyclic polyolefin resins. These resins may be blended for improving performance, or may be partially crosslinked for the purpose of, for example, improving heat resistance. When a body portion 5 to be described below of the cap body 4 is exposed to the retort treatment of high temperature heat sterilization, polypropylene having excellent heat resistance is preferably used. The cap body 4 may be formed of a single material or may have a multilayer structure including various resin layers.

As illustrated in FIGS. 1 to 3, the cap body 4 includes the body portion 5 that tubularly surrounds an outside in the caliber direction of the mouth portion 21*a* of the spout body 2, and a tab portion 6 that is disposed outside in the caliber direction with respect to the body portion 5.

The body portion 5 includes a tubular body portion main body 51 and a pedestal portion 52 projecting inward in the caliber direction from an inner peripheral surface of the body portion main body 51.

The pedestal portion 52 is formed over an entire circumference of the inner peripheral surface of the body portion main body 51, and is annular. Further, the pedestal portion 52 is for joining the sealing film F to an upper surface thereof. More specifically, the pedestal portion 52 includes an annular pedestal portion main body 52*a* and a film joint portion 52*b* projecting from an upper surface of the pedestal portion main body 52*a* for joining, the sealing film F.

An inner diameter of the pedestal portion main body 52*a* is formed to be slightly larger than an outer diameter of the mouth portion 21*a* of the spout body 2.

A plurality of film joint portions 52*b* is provided on the upper surface of the pedestal portion main body 52*a* apart from each other in the caliber direction. Then, the film joint portions 52*b* are formed over an entire circumference in a circumferential direction and are annular.

Further, as illustrated in FIGS. 4 to 6 and 8, the body portion main body 51 includes a pair of breaking portions 53 and 53 that breakably joins both sides in the circumferential direction from an end (a lower end in the drawing) on the container body side with respect to the tab portion 6, more specifically, a tab base portion 61 to be described below, and a pair of first slit portions 54 and 54 extending in the circumferential direction from end portions on the counter-container body side (an upper side in the drawing) of the pair of breaking portions 53 and 53.

The pair of first slit portions 54 and 54 penetrates in the caliber direction and extends in the circumferential direction from the end portions on the counter-container body side of the pair of breaking portions 53 and 53 toward a side opposite to the tab portion 6 (counter-tab portion side). The pair of first slit portions 54 and 54 is discontinuous and separated in the circumferential direction, as is clear from the term "pair". Further, the pair of first slit portions 54 and 54 is formed on the container body side with respect to the pedestal portion 52 as illustrated in FIG. 2.

Figure 4:
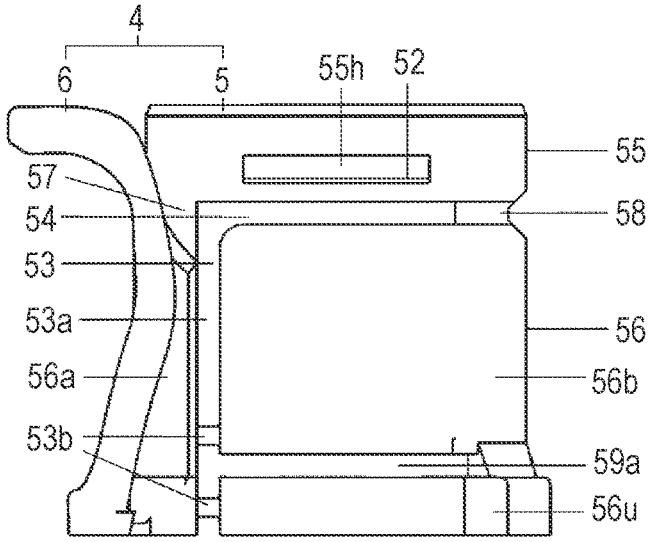
FIG. 4 is a front view illustrating a cap body of a spout cap used for the spout of the first embodiment.
Figure 6:
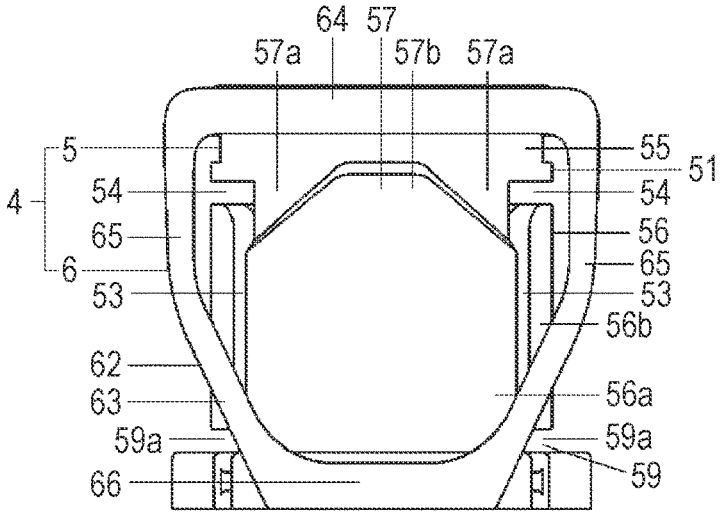
FIG. 6 is a left side view of the cap body of FIG. 4.
Figure 7:
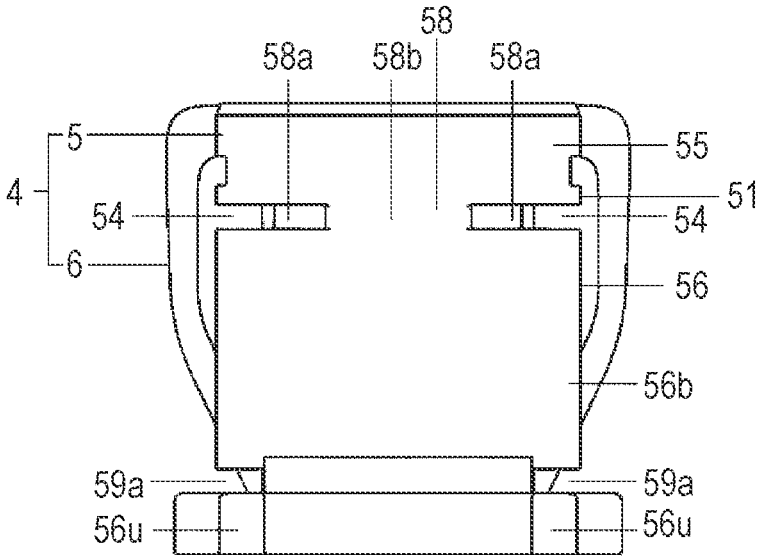
FIG. 7 is a right side view of the cap body of FIG. 4.

Further, as illustrated in FIGS. 4 and 6, the body portion main body 51 includes a first small body portion 55 located on the counter-container body side with the pair of first slit portions 54 and 54 as boundaries, a second small body portion 56 located on the container body side with the pair of first slit portions 54 and 54 as the boundaries, and a pair of intermediate joint portions 57 and 58 that joins the first small body portion 55 and the second small body portion 56 between the pair of first slit portions 54 and 54.

As illustrated in FIGS. 3 and 4, the first small body portion 55 includes through-holes 55*h* penetrating in the caliber direction. The through-holes 55*h* are formed to be separated from each other in the circumferential direction with respect to the first small body portion 55, Further, the through-hole 55*h* is formed on the counter-container body side with respect to the pedestal portion 52 (more specifically, the sealing film F). More specifically, regarding the penetration direction of the body portion 5, the through-hole 55*h* is formed not only on the counter-container body side with respect to the pedestal portion 52 but also in a portion opposed in the caliber direction with respect to the pedestal portion 52. Note that the through-hole 5511 is an elongated hole extending in the circumferential direction.

The through-hole 5511 functions as a drainage hole for passing liquid therethrough. Incidentally, the container with the spout may be filled with the contents and subjected to a sterilization treatment, with the spout cap 3 attached to the spout body 2. Liquids or gases such as vapor water droplets and cleaning agents used in the sterilization treatment may be collected on the sealing film F. The through-hole 55*h* is formed to pass the liquid or gas therethrough.

As illustrated in FIGS. 2, 4, 6 and 7, the second small body portion 56 includes a pair of split body portions 56*a* and 56*b* arranged separately on both sides in the circumferential direction with the pair of breaking portions 53 and 53 as boundaries in addition to the pair of breaking portions 53 and 53. What is described as 56*a* in the drawing is a split body portion on a tab portion side of the pair of split body portions 56*a* and 56*b*. Further, what is described as 56*b* in the drawing is a split body portion on the counter-tab portion side.

The breaking portion 53 extends from the end (lower end in the drawing) on the container body side in the penetration direction of the body portion 5 toward the counter-container body side (upper side) until it reaches the first slit portion 54. More specifically, the breaking portion 53 includes a gap portion 53*a* extending upward from the lower end of the body portion 5, and a pair of separation portions 53*b* that separably joins the split body portion 56*a* on the tab portion side and the split body portion 56*b* on the counter-tab portion side and partially closes a part of the gap portion 53*a*.

The pair of intermediate joint portions 57 and 58 is a pair of hinge portions 57 and 58 that respectively joins the split body portion 56*a* and the first small body portion 55 on the tab portion side, and the split body portion 56*b* and the first small body, portion 55 on the counter-tab portion side, and serves as fulcrums when the split body portion 56*a* on the tab portion side is rotationally displaced away from the container body side in the caliber direction.

A wall thickness of the hinge portion 57 on the tab portion side out of the pair of hinge portions is such that both side portions in the circumferential direction are a pair of thin-walled portions 57*a* and 57*a* thinner that of portions (the split body portion 56*a* on the tab portion side and the first small body portion 55) located above and below the hinge portion 57, and the intermediate portion in the circumferential direction is a thick-walled portion 57*b* thicker than the thin-walled portion 57*a*, incidentally, the thick-walled portion 57*b* has substantially the same thickness as the split body portion 56*a* on the tab portion side and the first small body portion 55. Further, positions of inner peripheral surfaces in the caliber direction of the hinge portion 57 on the tab portion side and the split body portion 56*a* on the tab portion side are located outside in the caliber direction of the first small body portion 55. Then, a position of an outer peripheral surface in the caliber direction of the hinge portion 57 on the tab portion side is such that the thick-walled portion 57*b* projects outward in the caliber direction with respect to the first small body portion 55, and the pair of thin-walled portions 57*a* and 57*a* is located in the same position as the first small body portion 55. Further, the hinge portion 57 on the tab portion side includes a reinforcing portion 57*c* that reinforcingly joins the thick-walled portion 57*b* to the split body portion 56*a* on the tab portion side and the pedestal portion 52, in addition to the pair of thin-walled portions 57*a* and 57*a* and the thick-walled portion 57*b*. The reinforcing portion 57*c* is formed in a part of a total length in a circumferential direction of the thick-walled portion 57*b*, and projects inward in the caliber direction with respect to the thick-walled portion 57*b*.

Further, the hinge portion 58 on the counter-tab portion side out of the pair of hinge portions also has, similarly to the hinge portion 57 on the tab portion side, a wall thickness such that both side portions in the circumferential direction are a pair of thin-walled portions 58*a* and 58*a* thinner that of portions (the split body portion 56*b* on the counter-tab portion side and the first small body portion 55) located above and below the hinge portion 57, and the intermediate portion in the circumferential direction is a thick-walled portion 58*b* thicker than the thin-walled portion 58*a*. Incidentally, the thick-walled portion 58*b* has substantially the same thickness as the split body portion Sob on the counter-tab portion side and the first small body portion 55. Further, a position of an inner peripheral surface in the caliber direction of the hinge portion 58 on the counter-tab portion side is such that a pair of thin-walled portions 58*a* and 58*a* is located at the same position as the first small body portion 55, and the thick-walled portion 58*b* is located inside in the caliber direction of the first small body portion 55 and the split body portion Sob on the counter-tab portion side. Then, a position of an outer peripheral surface in the caliber direction of the hinge portion 58 on the counter-tab portion side is located inside in the caliber direction of the first small body portion 55 and the split body portion 56*b* on the counter-tab portion side. Further, the intermediate portion (thick-walled portion 58*b*) of the hinge portion 58 on the counter-tab portion side is linear when viewed from the penetration direction. Note that the hinge portion 58 on the counter-tab portion side does not have one corresponding to the reinforcing portion 57*c* of the hinge portion 57 on the tab portion side.

As illustrated in FIGS. 2 and 3, the body portion 5 includes a cap-side fitting portion 59 that is fitted into a straw-side fitting portion 22 of the spout body 2 described above, in addition to the body portion main body 51 and the pedestal portion 52. Then, the cap-side fitting portion 59 and the straw-side fitting portion 22 are fitted to each other, so that the spout body 2 and the spout cap 3 are held in an integrated state. Note that the cap body 4 is made of resin, and an example of the material of the spout body 2 is the same resin as the resin used for the cap body 4.

The straw-side fitting portion 22 projects outward in the caliber direction from the outer peripheral surface of the straw 21 and is formed over the entire circumference in the circumferential direction. Therefore, the straw-side fitting portion 22 is annular and is a protrusion.

The cap-side fitting portion 59 includes a pair of second slit portions 59*a* and 59*a* that penetrates in the caliber direction and face each other in the caliber direction.

The pair of second slit portions 59*a* and 59*a* is elongated holes extending in the circumferential direction, and the straw-side fitting portion 22 is fitted inside the elongated holes. Incidentally, the pair of second slit portions 59*a* and 59*a* and the pair of first slit portions 54, 54 extend in the circumferential direction and face each other in the penetration direction. Then, the breaking portion 53 is formed to extend in a straight line in the penetration direction between end portions on the tab portion side in the circumferential direction of the first slit portion 54 and the second slit portion 59*a* that face each other in the penetration direction. Then, the second slit portion 59*a* is located between the two separation portions 53*b* and 53*b* provided apart from each other in the penetration direction.

Further, as illustrated in FIG. 3, a container body side portion with respect to the pair of second slit portions 59*a* and 59*a* of the body portion 5 (second small body portion 56) includes an edge portion 56*s* cooperating with the pair of breaking portions 53 and 53 to form a tubular shape, and a pair of inner flange portions 56*t* and 56*t* that projects inward in the caliber direction from the end portion on the counter-container body side (upper side) of the edge portion 56*s* and forms a surface on the counter-container body side of the pair of second slit portions 59*a* and 59*a*.

Figure 5:
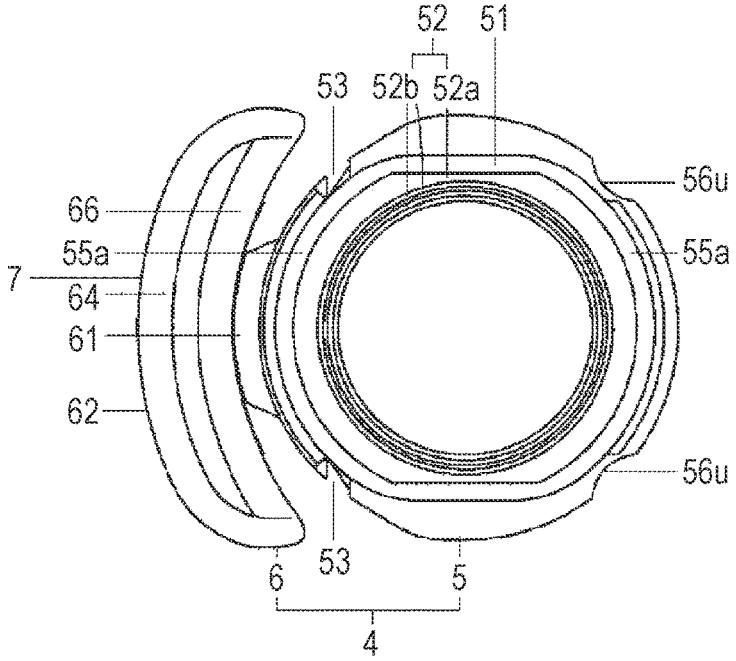
FIG. 5 is a plan view of the cap body of FIG. 4.
Figure 8:
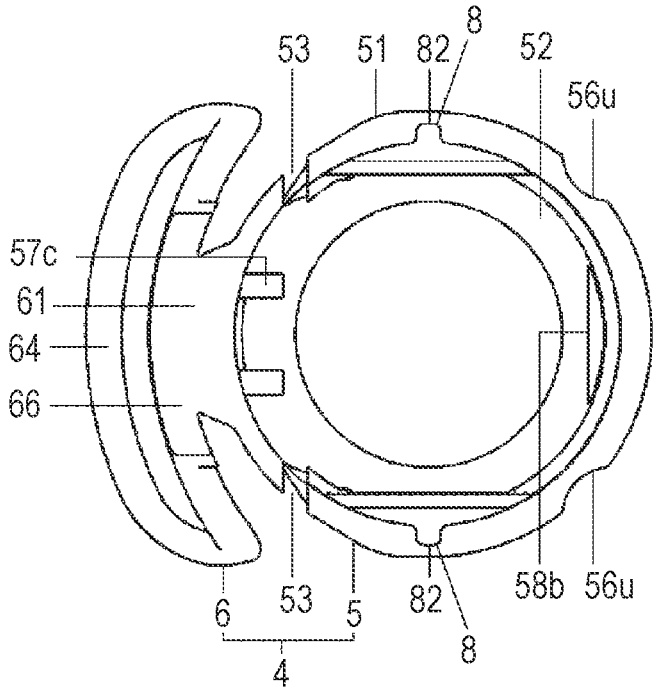
FIG. 8 is a bottom view of the cap body of FIG. 4.

The edge portion 56*s* and the pair of breaking portions 53 and 53 cooperate with each other to form the tubular shape as described above, and an inner diameter thereof is larger than an outer diameter of the straw-side fitting portion 22. Further, the edge portion 56*s* is separated into the counter-tab portion side and the tab portion side with the pair of breaking portions 53 and 53 as the boundaries, and as illustrated in FIGS. 5 and 8, an outer peripheral surface of the counter-tab portion side is provided with a local recess 56*u* that is locally recessed in a part in the circumferential direction. The local recess 56*u* is formed on the container body side with respect to an end portion on the counter-tab portion side in the circumferential direction of the second slit portion 59*a*. Then, the local recess 56*u* is formed thin with respect to a portion adjacent in the circumferential direction. When the spout cap 3 is removed from the spout body 2, the local recess 56*u* serves as a fulcrum and a strip-shaped portion located on the container body side portion with respect to the second slit portion 59*a* is displaced to open, which facilitates the opening operation of removing the spout cap 3.

The inner diameter of the inner flange portion 56*t* is smaller than the outer diameter of the straw side fitting portion 22. Therefore, in a state where the straw-side fitting portion 22 and the cap-side fitting portion 59 are fitted to each other, the pair of inner flange portions 56*t* and 56*t* is arranged on the container body side with respect to the straw-side fitting portion 22, and the spout cap 3 is prevented from being accidentally removed from the spout body 2.

As illustrated in FIGS. 1 and 2, the tab portion 6 includes the tab base portion 61 that projects outward in the caliber direction from the container body side in the penetration direction of the body portion main body 51, and a tab body portion 62 that extends from the tab base portion 61 to the counter-container body side in the penetration direction.

As illustrated in FIG. 5, the tab base portion 61 has a strip shape extending in the circumferential direction.

The tab body portion 62 is deformable outward in the caliber direction of the body portion 5 with respect to the tab base portion 61. More specifically, the tab body portion 62 can be deformed by utilizing elasticity of the resin so that the counter-container body side of the tab body portion 62 is apart outward in the caliber direction from the body portion 5 with the tab base portion 61 as a fulcrum.

Further, as illustrated in FIGS. 1 and 6, the tab body portion 62 is annular, and includes a bifurcated portion 63 that extends from the tab base portion 61 toward the counter-container body side in the penetration direction of the body portion 5 while branching in the circumferential direction of the body portion 5, and is apart in the circumferential direction on the counter-container body side, and a finger hook portion 64 that join end portions on the counter-container body side of the bifurcated portion 63 and is hooked by a finger.

The bifurcated portion 63 includes a pair of vertical frame portions 65 and 65 that extends in the penetration direction of the body portion 5 and faces each other in the circumferential direction, and a horizontal frame portion 66 that bridges between end portions on the container body side of the pair of vertical frame portions 65 and 65 and extends from an outside in the caliber direction of the tab base portion 61 to both sides in the circumferential direction.

Further, the tab body portion 62 faces the body 5 on the outside in the caliber direction, and as illustrated in FIG. 5, when viewed from the penetration direction of the body portion 5, the finger hook portion 64 is disposed apart outward in the caliber direction of the body portion 5 from the tab base portion 61 and the horizontal frame portion 66. Therefore, the tab body portion 62 penetrates in both the caliber direction and the penetration direction of the body portion 5.

Figure 9:
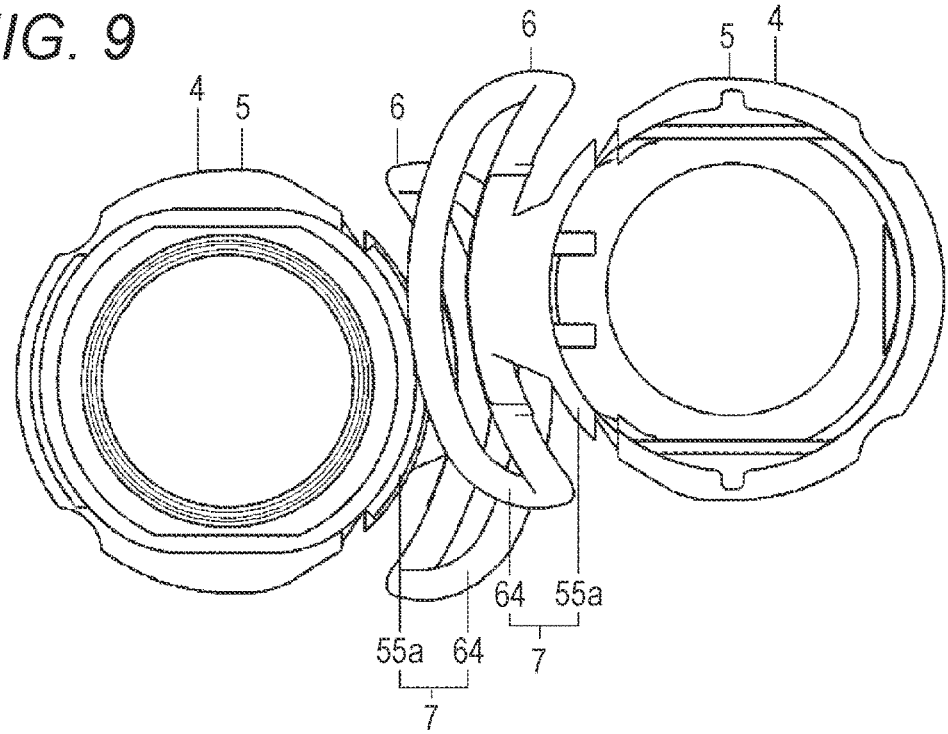
FIG. 9 is a plan view illustrating that two cap bodies are not entangled.
Figure 10:
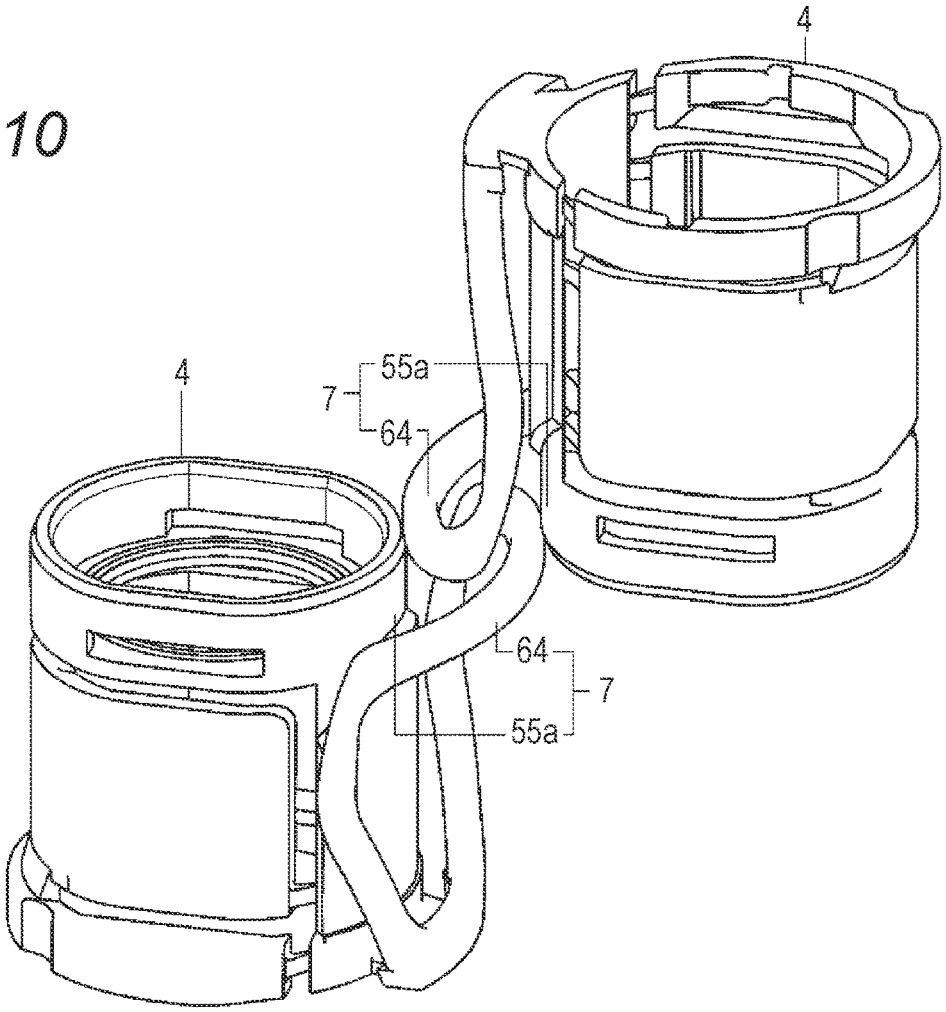
FIG. 10 is a perspective view illustrating that the two cap bodies are not entangled.

Further, as illustrated in FIGS. 9 and 10, the spout cap 3 includes an entanglement prevention portion 7 for preventing another spout cap 3 having the same shape from being entangled. The entanglement prevention portion 7 includes a portion of the body portion 5 (first small body portion 55) facing the finger hook portion 64, and the finger hook portion 64. The portion of the body portion 5 facing the finger hook portion 64 is an arcuate arc portion 55*a* that bulges outward in the caliber direction when viewed from the penetration direction, and the finger hook portion 64 also has an arc shape bulging outward in the caliber direction when viewed from the penetration direction. More specifically, the arc portion 55*a* and the finger hook portion 64 have an arcuate shape centered on a center of the body portion 5 when viewed from the penetration direction. Therefore, the finger hook portion 64 extends in the circumferential direction along an outer peripheral surface of the body portion 5. Then, a space portion formed between the finger hook portion 64 and the arc portion 55*a* also has an arc shape, so that the finger hook portion 64 of another spout cap 3 having the same shape does not enter the space portion. Therefore, even if the two spout caps 3 are turned upside down and overlap each other, the finger hook portion 64 of one spout cap 3 does not enter between the finger hook portion 64 and the arc portion 55*a* of the other spout cap 3, so that the two spout caps 3 and 3 are not entangled with each other. Incidentally, as illustrated in FIGS. 1 and 5, the arc portion 55*a* formed at a position not facing the tab portion 6 does not constitute the entanglement prevention portion. Further, in the body portion 5, a tubular cross-sectional shape thereof may be circular, and a portion other than the arc portion 55*a* constituting the entanglement prevention portion may have a linear shape or another shape such as a polygonal shape.

Further, as illustrated in FIGS. 1, 3 and 8, the spout 1 includes rotation prevention mechanism portions 8 that prevent the spout body 2 and the spout cap 3 from rotating relative to each other, for both the spout body 2 and the spout cap 3. Incidentally, in the present embodiment, the spout 1 includes two rotation prevention mechanism portions 8 and 8 separated from each other in the circumferential direction.

The rotation prevention mechanism portion 8 includes a protrusion 81 and a recess 82 that are fitted in the penetration direction of the body portion 5 in a state of being relatively non-rotatable in the circumferential direction. One of the protrusion 81 and the recess 82 is formed on the spout body 2, and the other is formed on the spout cap 3. More details are as follows.

The protrusion 81 protrudes from a surface (an upper surface) on the counter-container body side of the flange 23*a* on the most counter-container body side of the grip portion 23 of the spout body 2, and extends in the caliber direction.

The recess 82 has a shape that fits with the protrusion 81, and is recessed at an end surface (a lower surface) on the container body side of the body portion 5 of the spout cap 3, and the inside in the caliber direction thereof is opened and the outside in the caliber direction thereof is closed.

Since the two rotation prevention mechanism portions 8 and 8 are arranged to face each other in the caliber direction, the spout cap 3 cannot move in the caliber direction when it is fitted to the spout body 2. Further, as described above, since the inner diameter of the pedestal portion main body 52*a* is formed to be slightly larger than the outer diameter of the mouth portion 21*a* of the spout body 2, the mouth portion 21*a* of the spout body 2 is in a state of being immovably fitted to the pedestal portion 52 in the caliber direction, and thus the spout cap 3 is immovable in the caliber direction when it is fitted to the spout body 2.

The mold for manufacturing the cap body 4 of the spout cap 3 of the present embodiment described above is, for example, as follows. A direction of the spout cap 3 is set so that the penetration direction of the body portion 5 is aligned with a mold opening direction. Further, the mold includes a male mold and a female mold. Then, since the tab body portion 62 is formed to face the body portion 5 on the outside in the caliber direction, a recess corresponding to a cavity (space portion) can be formed only in the female mold of the mold for manufacturing the cap body 4, and it can be said that the structure is suitable for mass production in injection molding. Incidentally, at this time, a parting line is aligned with the end surface on the container body side of the body portion 5.

Further, in the spout cap 3 of the present embodiment, the tab body portion 62 is provided with the bifurcated portion 63 and the finger hook portion 64, and the tab body portion 62 is disposed outside in the caliber direction of the body portion 5 with respect to the tab base portion 61, and thus, the finger hook portion 64 is less likely to be undercut as compared to, for example, the spout cap in which the finger hook portion is overlapped with the tab base portion in the caliber direction when viewed from the penetration direction of the body portion, and the spout cap is more suitable for mass production by injection molding.

Incidentally, as the spout cap 3 having a structure unsuitable for mass production, there is one in which the tab portion is inclined to extend outward in the caliber direction toward the container body side in the penetrating direction with respect to the body portion. With such a structure, it is necessary to form the recess corresponding to the cavity not only in the female mold but also in the male mold, which makes mold design difficult.

Further, in the spout cap 3 of the present embodiment, the tab portion 6 extending in the penetrating direction of the body portion 5 is deformed outward in the caliber direction by utilizing the elasticity of the resin, so that it is easy to pass the finger through the tab body portion 62, which facilitates the opening operation of removing the cap body 4 from the mouth portion 21*a* of the spout body 2. Moreover, in the spout cap 3 of the present embodiment, since the finger hook portion 64 is apart outward in the caliber direction of the body portion 5 from the tab base portion 61 when viewed from the penetration direction of the body portion 5, a distance between the body portion 5 and the tab body portion 62 in the caliber direction is increased as compared to, for example, a spout cap (modification described below) in which the tab body portion is adjacent to the tab base portion in the caliber direction of the body portion when viewed from the penetration direction of the body portion, so that it is easy to pass the finger through the tab body portion 62, which facilitates the opening operation of removing the spout cap 3 from the mouth portion 21*a* of the spout body 2.

In order to assemble the spout cap 3 having the above-mentioned structure, first, the spout body 2 is covered with the spout cap 3, so that the mouth portion 21*a* of the spout body 2 is surrounded by the body portion 5 of the spout cap 3. Thus, the sealing film F of the spout cap 3 overlaps a tip surface of the straw 21 of the spout body 2 over the entire circumference in the circumferential direction. Then, their overlapping surfaces are melted by, for example, ultrasonic welding, and the sealing film F is thermally bonded to the tip surface of the mouth portion 21*a* of the spout body 2 over the entire circumference thereof. By doing so, the spout cap 3 of the present embodiment can securely close the mouth portion 21*a* of the spout body 2 by the sealing film F. Moreover, in the spout cap 3 of the present embodiment, since the cap body 4 surrounds the mouth portion 21*a* of the spout body 2, the mouth portion 21*a* can be sanitary.

Further, in the spout cap 3 of the present embodiment, the body portion 5 is provided with the arc portion 55*a*, and the finger hook portion 64 is also formed in the arc shape, and thus, for example, when a plurality of spout caps 3 is put into a parts feeder in order to attach the spout cap 3 to the spout body 2, the spout caps 3 are less likely to be entangled with each other in the finger hook portion 64, and productivity is improved.

Further, in the spout cap 3 of the present embodiment, since the body portion 5 includes the pair of breaking portions 53 and 53, the pair of first slit portions 54 and 54, and the pair of hinge portions 57 and 58, the opening operation of removing the spout cap 3 from the mouth portion 21*a* of the spout body 2 is easy. More specifically, such a spout cap 3 acts as follows in the opening operation of removing the spout cap 3 from the mouth portion 21*a* of the spout body 2.

Figure 11:
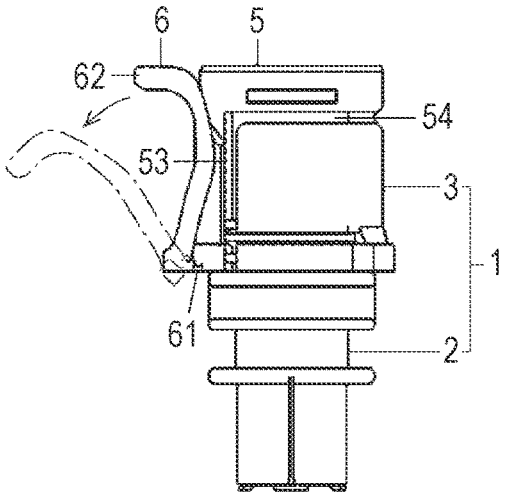
FIGS. 11(A), 11(B), and 11(C) are explanatory views illustrating a state change when the spout cap is removed from a spout body in the spout of the first embodiment.
Figure 11:
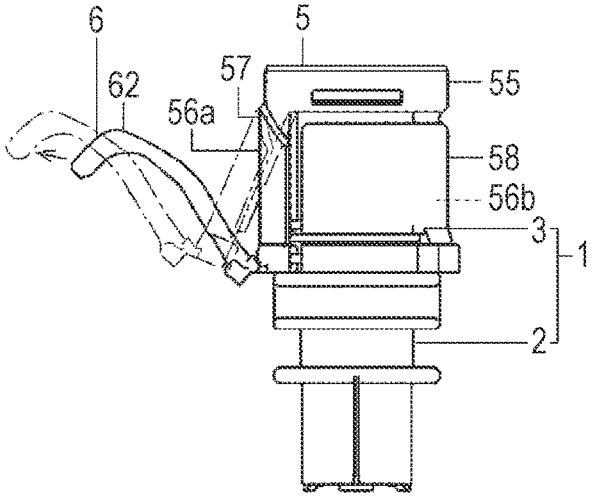
Figure 11:
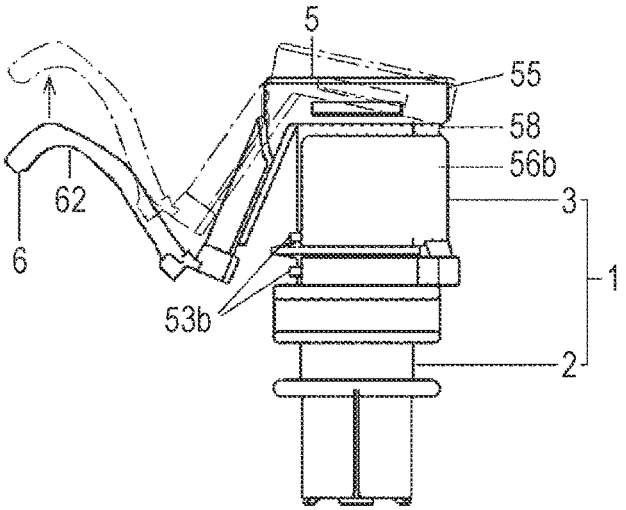

First, when the finger is passed through the tab body portion 62 of the spout cap 3, as shown by a one-dot chain line in FIG. 11(A), the tab body portion 62 is deformed outward in the caliber direction with the tab base portion 61 serves as the fulcrum.

Then, when the tab body portion 62 is pulled toward the counter-container body side, as shown by a one-dot chain line in FIG. 11(B), the tab body portion 62 is displaced to further expand outward in the caliber direction, the split body portion 56*a* on the tab portion side is displaced to open outward in the caliber direction with the hinge portion 57 as a fulcrum, and the separation portions 53*b* of the pair of breaking portions 53 and 53 is torn and broken. Then, along the broken breaking portion 53, the container body side (second small body portion 56) of the body portion 5 is divided into the split body portion 56*a* on the tab portion side and the split body portion 56*b* on the counter-tab portion side. Incidentally, at this stage, the sealing film F is in a state of being joined to the tip surface of the mouth portion of the spout body 2.

Further, when the tab body portion 62 is pulled toward the counter-container body side, as shown by a one-dot chain line in FIG. 11(C), the split body portion 56*a* on the tab portion side is displaced to expand outward in the caliber direction with respect to the split body portion 56*b* on the counter-tab portion side, together with the first small body portion 55 with the hinge portion 58 as a fulcrum, and the first slit portion 54 is deformed with this displacement. At this time, although not shown, the sealing film F is peeled off from the tip surface of the mouth portion of the spout body 2.

Therefore, since the spout cap 3 of the present embodiment has the pair of breaking portions 53 and 53, the pair of first slit portions 54 and 54, and the pair of hinge portions 57 and 58, the opening operation is easier than that of, for example, the spout cap without these portions. Further, the spout cap 3 of the present embodiment can be removed from the spout body 2 by only one operation of pulling the tab portion 6. Furthermore, since the first slit portion 54 and the gap portion 53*a* of the breaking portion 53 penetrate in the caliber direction of the body portion, the breaking portion 53 can be broken (torn) with a light force, so that the opening operation is easy.

Figure 12:
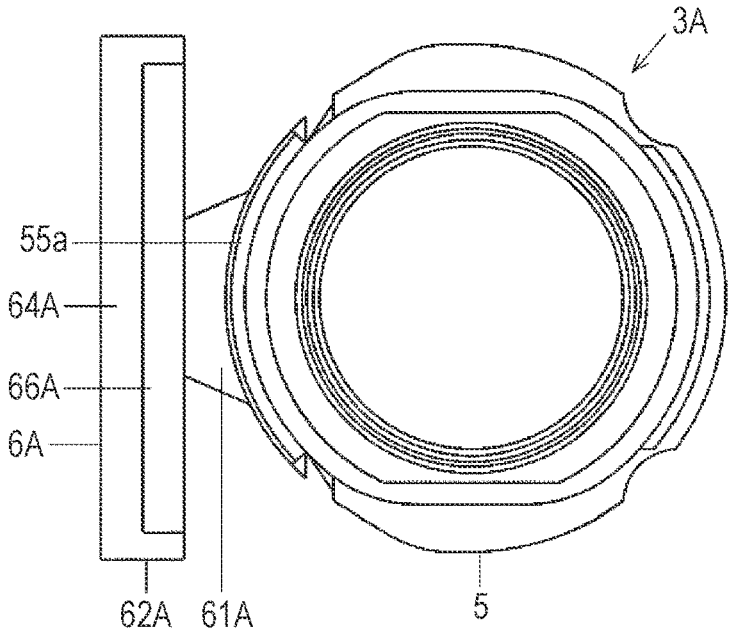
FIG. 12 is a plan view illustrating a modification of the cap body used for the spout cap in the first embodiment.
Figure 13:
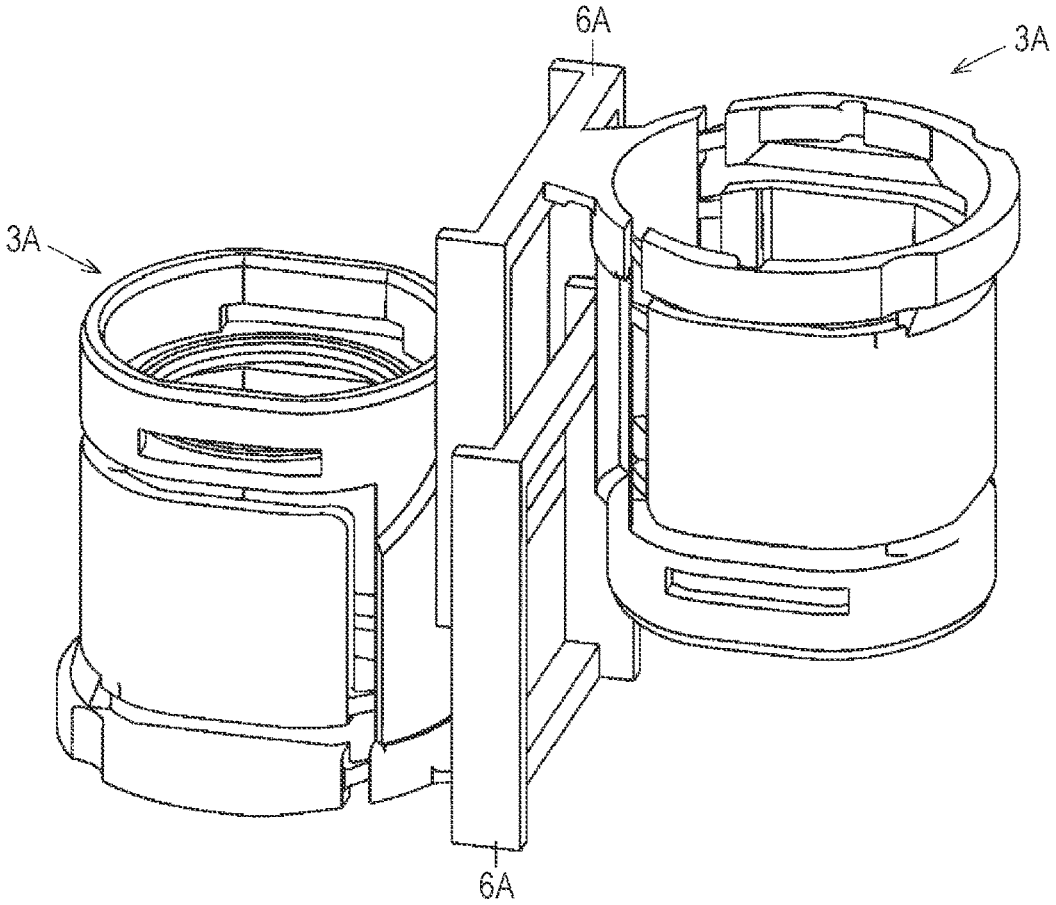
FIG. 13 is a perspective view illustrating that modifications of the cap body used for the spout cap in the first embodiment are entangled.

Further, FIGS. 12 and 13 illustrate a spout cap 3A of a modification used for the spout of the first embodiment. The spout cap 3A has a tab portion 6A extending parallel to a tangential direction of the arc portion 55*a* of the body portion 5 when viewed from the penetrating direction. More specifically, a tab base portion 61A of the tab portion 6A extends parallel to the tangential direction with respect to the arc portion 55*a*. Then, a finger hook portion 64A and a horizontal frame portion 66A of a tab body portion 62A of the tab portion 6A also extend in parallel to the tangential direction. Further, the tab body portion 62A faces the body portion 5 on the outside in the caliber direction. Then, when viewed from the penetrating direction, the finger hook portion 64A and the horizontal frame portion 66A are adjacent, to each other in the caliber direction. In this case, a gap is formed between the arc portion 55*a* of the body portion 5 and the finger hook portion 64 so that the finger hook portion 64 of another spout cap 3A having the same shape can be inserted when viewed from the penetrating direction. Therefore, when the two spout caps 3A are turned upside down and overlap each other, the finger hook portion 64 of one spout cap 3A may enter between the finger hook portion 64 and the arc portion 55*a* of the other spout cap 3A. In this case, the arc portion 55*a* of the body portion 5 and the finger hook portion 64 do not constitute the entanglement prevention portion.

Next, the spout of a second embodiment of the present invention will be described below. The spout cap of the spout of the present embodiment (hereinafter, referred to as the spout cap of the second embodiment) is different from the spout cap of the first embodiment, and the spout body fitted thereto is the same as the spout body of the first embodiment.

Figure 14:
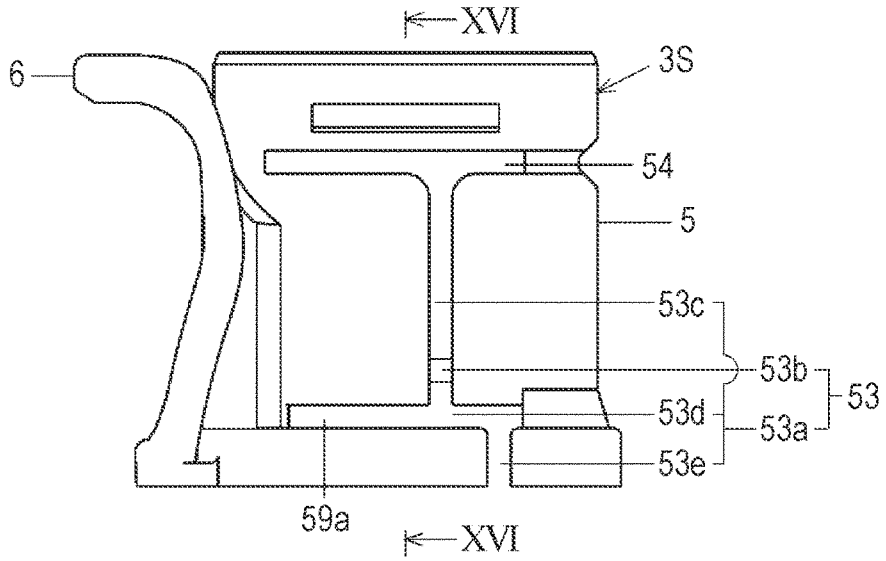
FIG. 14 is a front view illustrating the cap body used for the spout cap in a second embodiment.
Figure 15:
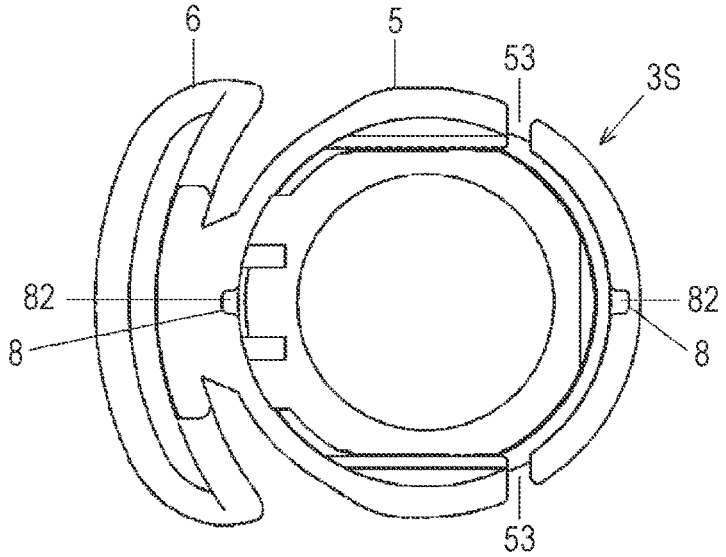
FIG. 15 is a plan view of the cap body of FIG. 14.
Figure 16:
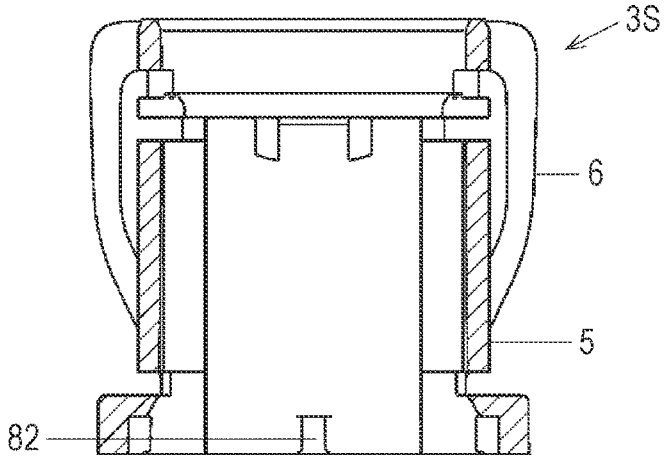
FIG. 16 is a cross-sectional view taken along a line XVI-XVI of the cap body of FIG. 14.

In a spout cap 3S of the second embodiment, as illustrated in FIGS. 14 to 16, the body portion 5 has the pair of first slit portions 54 and 54, the pair of breaking portions 53 and 53, and the pair of second slit portions 59*a* and 59*a*, and the breaking portion 53 is formed in a state of being connected to an intermediate portion in the circumferential direction between the first slit portion 54 and the second slit portion 59*a* located on the same side in the circumferential direction. Moreover, in the breaking portion 53, the intermediate portion of the total length in the penetrating direction is formed in a bent line shape bent in the circumferential direction. More specifically, the gap portion 53*a* of the breaking portion 53 includes a first straight portion 53*c* extending in the penetrating direction between the first slit portion 54 and the second slit portion 59*a* located on the same side in the circumferential direction, a second straight portion 53*d* that is a part of the second slit portion 59*a* and extends in the circumferential direction so as to be apart from the tab portion side, and a third straight portion 53*e* extending in the penetrating direction from an end portion of the second straight portion 53*d* that is apart from the first straight portion 53*c*. Further, the separation portion 53*b* of the breaking portion 53 is formed only in the first straight portion 53*c*, and partially closes a part of the first straight portion 53*c* to separably join the pair of split body portions 56*a* and 56*b*.

Further, in the spout cap 3S of the second embodiment, the recess 82 as the rotation prevention mechanism portion 8 is formed on the counter-tab portion side and the tab portion side in the circumferential direction with respect to the pair of breaking portions 53 and 53. More specifically, the spout cap 3S of the second embodiment has the recess 82 formed at a position different from that of the recess 82 as the rotation prevention mechanism portion 8 of the spout cap 3 of the first embodiment, in the circumferential direction of the body portion 5.

The present invention is not limited to the above embodiments, and can be appropriately modified without departing from the spirit of the present invention.

For example, the hinge portions 57 and 58 are provided with the pair of thin-walled portions and the thick-walled portion, but the present invention is not limited to this, and for example, only the thin-walled portion may be provided.

Further, the pair of intermediate joint portions 57 and 58 are both hinge portions, but the present invention is not limited to this, and the intermediate joint portion 57 on the tab portion side may not function as the hinge portion. Even in this case, the opening operation of removing the spout cap 3 from the mouth portion 21*a* of the spout main body 2 can be performed in the same manner as in the above embodiments. Further, in this case, the separation portion 53*b* is cut and the sealing film F is peeled off at the same time, and a larger force is required for opening than in the case of the above embodiments. Therefore, the above embodiments are preferable to the case where the intermediate joint portion 57 on the tab portion side does not function as the hinge portion.

LIST OF THE REFERENCE NUMERALS

1: Spout, 2: Spout body, 21: Straw, 24*a*: Mouth portion, 21*b*: Container attachment portion, 22: Straw-side fitting portion, 23: Grip portion, 23*a*: Flange, 3, 3A, 3S: Spout cap, 4: Cap body, 5: Body portion, 51: Body portion main body, 52: Pedestal portion, 52*a*: Pedestal portion main body, 52*b*: Film joint portion, 53: Breaking portion, 53*a*: Gap portion, 53*b*: Separation portion, 53*c*: First straight portion, 53*d*: Second straight portion, 53*e*: Third straight portion, 54: First slit portion, 55: First small body portion, 55*a*: Arc portion, 55*h*: Through-hole, 56: Second small body portion, 56*a*, 56*b*: Split body portion, 56*s*: Edge portion, 56*t*: Inner flange portion, 56*u*: Local recess, 57, 58: Intermediate joint portion (Hinge portion), 57*a*, 58*a*: Thin-walled portion, 57*b*, 58*b*: Thick-walled portion, 57*c*: Reinforcing portion, 59: Cap-side fitting portion, 59*a*: Second slit portion, 6, 6A: Tab portion, 61, 61A: Tab base portion, 62, 62A: Tab body portion, 63: Bifurcated portion, 64, 64A: Finger hook portion, 65: Vertical frame portion, 66, 66A: Horizontal frame portion, 7: Entanglement prevention portion, 8. Rotation prevention mechanism portion, 81: Protrusion, 82: Recess, F: Sealing film.

The invention claimed is:

1. A spout cap comprising: a cap body that is an injection molded article made of resin, and tubularly surrounds a mouth portion of a spout body; and a sealing film that is a laminated film, and is bonded to one side in a tubular penetration direction of the cap body and can be thermally bonded to a tip surface of the mouth portion to seal the mouth portion of the spout body, wherein the cap body includes a tubular body portion, and a tab portion disposed outside in a caliber direction of the body portion, the body portion includes a tubular body portion main body and a pedestal portion projecting inward in the caliber direction from an inner peripheral surface of the body portion main body, the body portion main body includes:

a pair of discontinuous slit portions, each extending in a circumferential direction of the body portion and penetrating in the caliber direction of the body portion;

a first small body portion located on the one side in the penetration direction with the pair of slit portions as boundaries; and a second small body portion located on other side in the penetration direction with the pair of slit portions as the boundaries, the pair of slit portions are located on the other side in the penetration direction with respect to the pedestal portion, the sealing film is joined with a surface of the pedestal portion at the one side in the penetration direction, the tab portion includes a tab base portion that projects outward in the caliber direction from the other side in the penetration direction of the body portion, and a tab body portion that extends from the tab base portion toward the one side in the penetration direction and faces the body portion on an outside in the caliber direction, and the tab body portion is annular and can be deformed outward in the caliber direction of the body portion with respect to the tab base portion.

2. The spout cap according to claim 1, wherein the tab body portion includes a bifurcated portion extending to the one side in the penetration direction while branching in the circumferential direction of the body portion from the tab base portion, and a finger hook portion that joins both end portions on the one side of the bifurcated portion and is hooked by a finger, and the finger hook portion is disposed outside in the caliber direction of the body portion with respect to the tab base portion.

3. The spout cap according to claim 2, wherein the finger hook portion is disposed apart outward in the caliber direction of the body portion from the tab base portion.

4. The spout cap according to claim 2, wherein the body portion includes an arcuate arc portion that bulges outward in the caliber direction when viewed from the penetration direction, and the finger hook portion also has an arcuate shape that bulges outward in the caliber direction when viewed from the penetration direction of the body portion, and is disposed apart outward in the caliber direction from the arc portion.

5. The spout cap according to claim 1, wherein the body portion includes a pair of breaking portions that breakably joins both sides in the circumferential direction with respect to the tab base portion and extends toward one side from the other side end in the penetration direction of the body portion, the pair of slit portions extending in the circumferential direction from the one side end of the pair of breaking portions, and a pair of intermediate joint portions that joins the first small body portion and the second small body portion between the pair of slit portions, and the intermediate joint portion on an opposite side of the tab portion out of the pair of intermediate joint portions is a hinge portion.

6. A spout comprising the spout cap according to claim 1 and the spout body attached to a mouth portion of a container body.

7. A container with a spout comprising the spout according to claim 6 and the container body.

* * * * *